US008089454B2

(12) United States Patent
Saito

(10) Patent No.: US 8,089,454 B2
(45) Date of Patent: Jan. 3, 2012

(54) DRIVING CIRCUIT FOR ELECTROPHORETIC DISPLAY DEVICE, ELECTROPHORETIC DISPLAY DEVICE, METHOD FOR DRIVING THE SAME, AND ELECTRONIC APPARATUS

(75) Inventor: Hidetoshi Saito, Suwa (JP)

(73) Assignee: Seiko Epson Corporation (JP)

( * ) Notice: Subject to any disclaimer, the term of this patent is extended or adjusted under 35 U.S.C. 154(b) by 514 days.

(21) Appl. No.: 12/366,919

(22) Filed: Feb. 6, 2009

(65) Prior Publication Data

US 2009/0237383 A1 Sep. 24, 2009

(30) Foreign Application Priority Data

Mar. 24, 2008 (JP) ..... 2008-075654

(51) Int. Cl.
*G09G 3/34* (2006.01)

(52) U.S. Cl. ..... 345/107; 345/108; 359/296

(58) Field of Classification Search ..... 345/107, 345/108, 204, 690
See application file for complete search history.

(56) References Cited

U.S. PATENT DOCUMENTS 7,656,384 B2 * 2/2010 Saito ..... 345/107
7,755,599 B2 * 7/2010 Miyasaka ..... 345/107
7,812,812 B2 * 10/2010 Yoshinaga et al. ..... 345/107

FOREIGN PATENT DOCUMENTS

JP 2004-102054 4/2004

* cited by examiner

*Primary Examiner* — Duc Dinh
(74) *Attorney, Agent, or Firm* — Harness, Dickey & Pierce, P.L.C.

(57) ABSTRACT

In an electrophoretic device including a display including pixels with electrophoretic particles between pixel and common electrodes, a pixel-switching element, a memory holding an image signal from the pixel-switching element, and a switch connecting one of first and second control lines to the pixel electrode according to a signal output according to the image signal from the memory, a driving circuit includes a holding voltage unit supplying a holding voltage holding the image signal in the memory, a pixel potential unit supplying a first pixel potential to the first control line and a different second pixel potential to the second control line, a common potential unit supplying a common potential to the common electrode, and a control unit controlling the holding potential unit, the common potential unit, and the pixel potential unit to stop the holding potential after the first and second pixel potentials and common potential are stopped.

6 Claims, 10 Drawing Sheets

DRIVING CIRCUIT FOR ELECTROPHORETIC DISPLAY DEVICE, ELECTROPHORETIC DISPLAY DEVICE, METHOD FOR DRIVING THE SAME, AND ELECTRONIC APPARATUS

BACKGROUND

1. Technical Field

The present invention relates to a driving circuit for an electrophoretic display device, the electrophoretic display device, a method for driving the electrophoretic display device, and an electronic apparatus.

2. Related Art

In general, electrophoretic display devices include display units which perform display operations using a plurality of pixels as described below. In each of the pixels, after an image signal is written to a memory circuit through a pixel switching element, a pixel electrode is driven using a pixel potential generated in accordance with the written image signal, and accordingly, a potential difference is generated between the pixel electrode and a common electrode. By this, an electrophoretic element between the pixel electrode and the common electrode is driven whereby the display operation is performed. Since the electrophoretic element has a characteristic in which once the electrophoresis element is driven, the electrophoresis element retains a state attained after being driven without keeping applying voltage, application of the voltage may be stopped (that is, a high-impedance state) once the electrophoresis element is driven (refer to Japanese Unexamined Patent Application Publication No. 2004-102054, for example).

However, immediately after the pixel electrode and the common electrode are brought to high impedance states, a kickback phenomenon in which electrophoretic particles which have moved toward the pixel electrode and the common electrode are moved back toward the center (that is, in a direction in which the electrophoretic particles are moved away from the electrodes) occurs. Therefore, for example, contrast of a displayed image is deteriorated due to the kickback phenomenon. Accordingly, in the technique described above, there arises a technical problem in that image quality may be deteriorated since the pixel electrode and the common electrode are brought to the high impedance states.

SUMMARY

An advantage of some aspects of the invention is to provide a driving circuit for an electrophoretic display device capable of displaying a high-quality image, the electrophoretic display device, a method for driving the electrophoretic display device, and an electronic apparatus.

According to an aspect of the present invention, there is provided a driving circuit for an electrophoretic display device which includes a display unit including a plurality of pixels each of which includes an electrophoretic element which has electrophoretic particles interposed between a pixel electrode and a common electrode facing the pixel electrode, a pixel-switching element, a memory circuit capable of holding an image signal supplied through the pixel-switching element, and a switching circuit used to electrically connect one of first and second control lines to the pixel electrode in accordance with a signal output in response to the image signal supplied from the memory circuit. The driving circuit further includes a holding voltage supplying unit configured to supply a holding voltage used to hold the image signal to the memory circuit, a pixel potential supplying unit configured to supply a first pixel potential to the first control line and a second pixel potential, which is different from the first pixel potential, to the second control line, a common potential supplying unit configured to supply a common potential to the common electrode, and a control unit configured to control the holding potential supplying unit, the common potential supplying unit, and the pixel potential supplying unit so that supply of the holding potential is stopped after supply of the first and second pixel potentials and supply of the common potential are stopped.

Accordingly, while the driving circuit for the electrophoretic display device operates, by applying a voltage between the pixel electrode and the common electrode included in each of the plurality of pixels included in the display unit of the electrophoretic display device in accordance with the image signal, the electrophoretic particles included in the electrophoretic element interposed between the pixel electrode and the common electrode are moved in a range between the pixel electrode and the common electrode, whereby an image is displayed in the display unit. Specifically, for example, the electrophoretic element which is a microcapsule includes, as the electrophoretic particles, a plurality of white particles electrically charged in negative and a plurality of black particles electrically charged in positive. In accordance with the voltage applied between the pixel electrode and the common electrode, the plurality of white particles electrically charged in negative or the plurality of black particles electrically charged in positive are moved (migrated) on the pixel electrode side and the others are moved on the common electrode side. By this, an image is displayed on the common electrode side.

With this configuration, before the image is displayed, for example, the image signal is supplied from a data line through the pixel switching element to the memory circuit, and the image signal is held in the memory circuit. Here, the memory circuit includes an SRAM (Static Random Access Memory), for example, and is capable of holding the image signal by receiving the holding potential from the holding potential supplying unit. Then, in accordance with a signal output in response to the image signal held in the memory circuit, the switch circuit electrically connects one of the first and second control lines to the pixel electrode. Specifically, the switch circuit includes a plurality of switching elements, for example, and selects one of the first and second control lines as a control line to be electrically connected to the pixel electrode in accordance with the signal output from the memory circuit. The pixel potential supplying unit supplies the first pixel potential to the first control line. Therefore, the first pixel potential is supplied through the first control line to the pixel electrode which is electrically connected to the first control line. Similarly, the pixel potential supplying unit supplies the second pixel potential, which is different from the first pixel potential, to the second control line. Therefore, the second pixel potential is supplied through the second control line to the pixel electrode which is electrically connected to the second control line. The common potential supplying unit supplies the common potential to the common electrode which faces the pixel electrode. Therefore, a voltage represented by a difference between the first and second pixel potentials and the common potential is applied between the pixel electrode and the common electrode.

With this configuration, the electrophoretic element which has been driven by applying a voltage is likely to keep a state immediately after the driving of the electrophoretic element is stopped. Specifically, the electrophoretic particles included in the electrophoretic element are likely to stay positions where the electrophoretic particles are positioned after being moved by the driving. That is, for example, by stopping the supply of the first and second pixel potentials, the supply of the common potential, and the supply of the holding potential (that is, they are brought to high-impedance states) after the driving, power consumption is reduced.

With this configuration, in particular, the control unit controls the holding potential supplying unit, the common potential supplying unit, and the pixel potential supplying unit so that the supply of the holding potential is stopped after the supply of the first and second pixel potentials and the supply of the common potential are stopped. That is, the supply of the holding potential to the memory circuit is stopped later than the supply of the potentials to the pixel electrode and the common electrode. If the supply of the first and second pixel potentials, the supply of the common potential, and the supply of the holding potential are simultaneously stopped or if the supply of the holding potential is stopped earlier than the supply of the other potentials, a kickback phenomenon occurs and the electrophoretic particles which have been moved are likely to be moved back to positions before being moved. When the kickback phenomenon occurs, contrast of a displayed image, for example, may be deteriorated.

With this configuration, in particular, as described above, the supply of the holding potential is stopped later than the supply of the other potentials. Therefore, occurrence of the kickback phenomenon can be reliably suppressed. Accordingly, the contrast, for example, is also prevented from being deteriorated, and consequently, quality of the displayed image is improved. Note that, the kickback phenomenon described above can be suppressed by controlling humidity of the electrophoretic element. However, since it is difficult to quantitatively control the humidity, an advantage may not reliably obtained. However, according to the aspect of the invention, by controlling a timing in which the supply of the holding potential is stopped, the kickback phenomenon is suppressed with a comparatively simple configuration.

As described above, according to the driving circuit for the electrophoretic display device of the embodiment of the invention, the kickback phenomenon is suppressed with a simple configuration. Consequently, a high-quality image is displayed.

The control unit may control the holding potential supplying unit so that the holding potential obtained in a period after the supply of the first and second pixel potentials and the supply of the common potential are stopped and before the supply of the holding potential is stopped is lower than the holding potential obtained when the supply of the first and second pixel potentials and the supply of the common potential are stopped.

Accordingly, in a period after the supply of the first and second pixel potentials and the supply of the common potential are stopped, the holding potential is controlled so as to be lower than that obtained immediately after the supply of the first and second pixel potentials and the supply of the common potential are stopped. Then, as described above, after the holding potential is lowered, the supply of the holding potential is stopped. That is, the holding potential supplied to the memory circuit is lowered and then the supply thereof is stopped.

When the electrophoretic element is driven in practical use (that is, while the first and second pixel potentials and the common potential are supplied), a comparatively high value is set to the holding potential so that the electrophoretic element is appropriately driven. However, when the supply of the first and second pixel potentials and the supply of the common potential are stopped, the driving of the electrophoretic element is stopped. Therefore, after the supply of the first and second pixel potentials and the supply of the common potential are stopped, it is not necessary to set a high value to the holding potential. Accordingly, for example, in a case where the holding potential is 15 V while the electrophoretic element is driven, and the holding potential is lowered to 5V after the supply of the first and second pixel potentials and the supply of the common potential are stopped, power consumption can be reduced in accordance with a difference between the holding potentials.

Note that a possibility of deterioration of the advantage in which the kickback phenomenon is reduced due to the holding potential lowered as described above is negligible. For example, in a case where the holding potential is lowered to a threshold voltage of the switching element included in the switching circuit (that is, a voltage corresponding to a threshold value of switching control), suppression of the kickback phenomenon is ensured.

The control unit may control the holding potential supplying unit, the common potential supplying unit, and the pixel potential supplying unit so that the supply of the holding potential is stopped at least 100 msec after the supply of the first and second pixel potentials and the supply of the common potential are stopped.

Accordingly, the supply of the holding potential is stopped at least 100 msec after the supply of the first and second pixel potentials and the supply of the common potential are stopped. According to research of the inventor, if the supply of the holding potential is stopped at least 100 msec after the supply of the first and second pixel potentials and the supply of the common potential are stopped, the occurrence of the kickback phenomenon is reliably reduced. Accordingly, with this control described above, the occurrence of the kickback phenomenon is suppressed, and a high-quality image is displayed.

Note that the supply of the holding potential is preferably stopped several seconds after the supply of the first and second pixel potentials and the supply of the common potential are stopped. With this control, the kickback phenomenon is effectively suppressed.

According to another aspect of the invention, there is provided an electrophoretic display device including a display unit including a plurality of pixels each of which includes an electrophoretic element which has electrophoretic particles interposed between a pixel electrode and a common electrode facing the pixel electrode, a pixel-switching element, a memory circuit capable of holding an image signal supplied through the pixel-switching element, and a switching circuit used to electrically connect one of first and second control lines to the pixel electrode in accordance with a signal output in response to the image signal supplied from the memory circuit, a holding voltage supplying unit configured to supply a holding voltage used to hold the image signal to the memory circuit, a pixel potential supplying unit configured to supply a first pixel potential to the first control line and a second pixel potential, which is different from the first pixel potential, to the second control line, a common potential supplying unit configured to supply a common potential to the common electrode, and a control unit configured to control the holding potential supplying unit, the common potential supplying unit, and the pixel potential supplying unit so that supply of the holding potential is stopped after supply of the first and second pixel potentials and supply of the common potential are stopped.

With this configuration, as with the case of the driving circuit for the electrophoretic display device described above, the holding potential obtained in a period after the supply of the first and second pixel potentials and the supply of the common potential are stopped is lower than the holding potential obtained immediately after the supply of the first and second pixel potentials and the supply of the common potential are stopped. Accordingly, the kickback phenomenon is suppressed with a comparatively simple method. Consequently, a high-quality image is displayed.

According to still another aspect of the invention, there is provided a method for driving an electrophoretic display device including a display unit including a plurality of pixels each of which includes an electrophoretic element which has electrophoretic particles interposed between a pixel electrode and a common electrode facing the pixel electrode, a pixel-switching element, a memory circuit capable of holding an image signal supplied through the pixel-switching element, and a switching circuit used to electrically connect one of first and second control lines to the pixel electrode in accordance with a signal output in response to the image signal supplied from the memory circuit. The method includes supplying a holding voltage used to hold the image signal to the memory circuit, supplying a first pixel potential to the first control line and a second pixel potential, which is different from the first pixel potential, to the second control line, and supplying a common potential to the common electrode. Supply of the holding potential is stopped after supply of the first and second pixel potentials and supply of the common potential are stopped.

With this configuration, as with the case of the driving circuit for the electrophoretic display device described above, the holding potential obtained in a period after the supply of the first and second pixel potentials and the supply of the common potential are stopped is lower than the holding potential obtained immediately after the supply of the first and second pixel potentials and the supply of the common potential are stopped. Accordingly, the kickback phenomenon is suppressed with a comparatively simple method. Consequently, a high-quality image is displayed.

According to a further aspect of the invention, there is provided an electronic apparatus including the electrophoretic display device described above (the invention includes modifications thereof).

Since the electronic apparatus includes the electrophoretic display device described above, various electronic apparatuses capable of displaying high-quality images, such as a wrist watch, an electronic sheet, an electronic note, a cellular phone, and a mobile audio apparatuses, are attained.

Operations and advantages of the invention will be apparent from an exemplary embodiment described hereinafter.

BRIEF DESCRIPTION OF THE DRAWINGS

The invention will be described with reference to the accompanying drawings, wherein like numbers reference like elements.

DESCRIPTION OF EXEMPLARY EMBODIMENTS

An Embodiment of the present invention will be described hereinafter with reference to the accompanying drawings.

First, an entire configuration of an electrophoretic display device according to this embodiment will be described with reference to FIGS. 1 and 2. Note that, hereinafter, in addition to the configuration of the electrophoretic display device according to this embodiment, a configuration of a driving circuit for the electrophoretic display device according to this embodiment which is included in the electrophoretic display device will be described.

Figure 1:
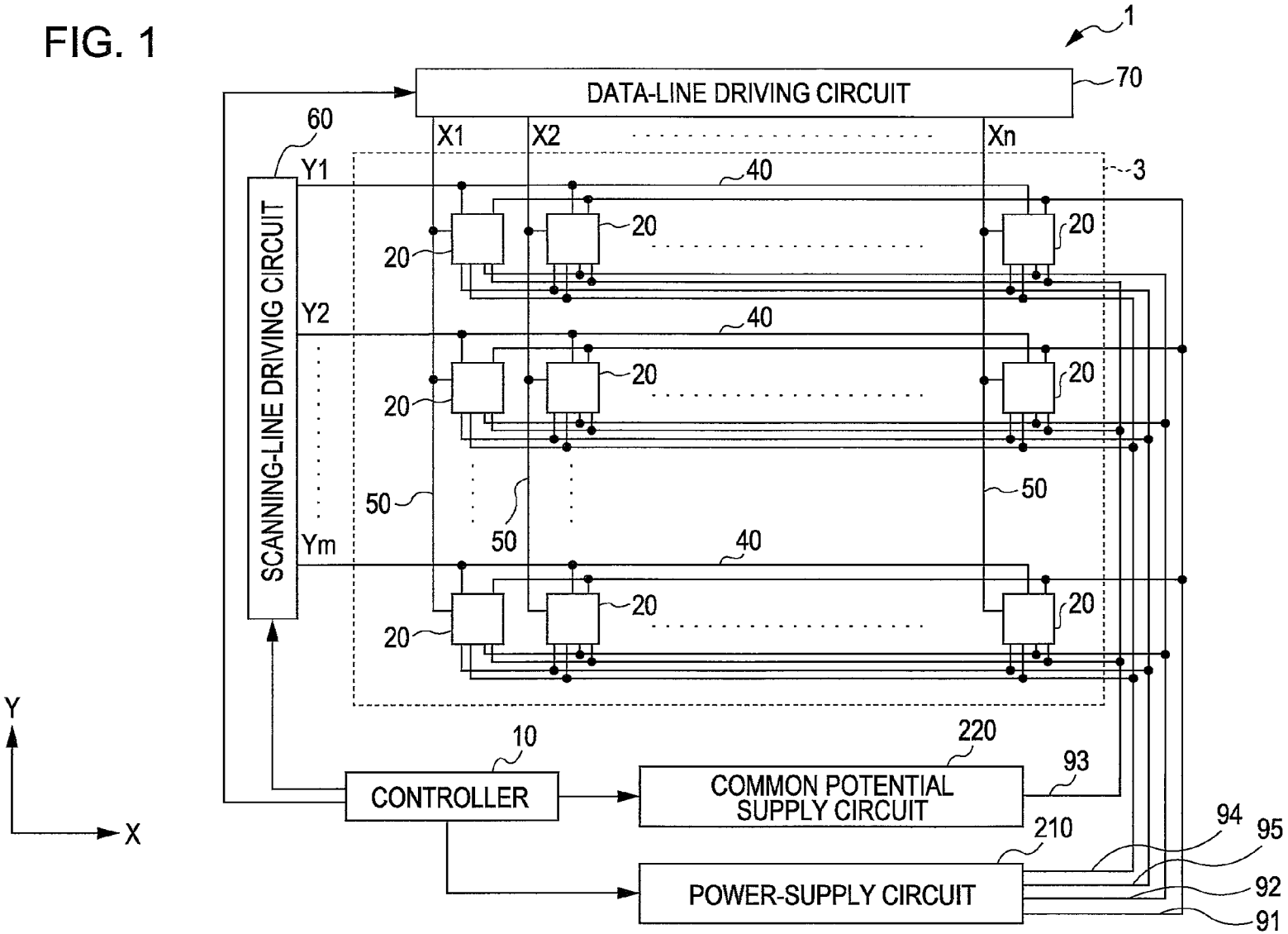
FIG. 1 is a block diagram illustrating an entire configuration of an electrophoretic display device according to an embodiment.

FIG. 1 is a block diagram illustrating the entire configuration of the electrophoretic display device according to this embodiment.

In FIG. 1, an electrophoretic display device 1 according to this embodiment includes a display unit 3, a controller 10, a scanning-line driving circuit 60, a data-line driving circuit 70, a power-supply circuit 210, and a common potential supply circuit 220.

The display unit 3 includes pixels 20 arranged in a matrix (two-dimensional plane) of m rows×n columns. Furthermore, the display unit 3 includes m scanning lines 40 (that is, scanning lines Y1 to Ym) and m data lines 50 (that is, data lines X1 to Xn) so that the n scanning lines 40 and the m data lines 50 intersect with each other. Specifically, the m scanning lines 40 extend in a row direction (that is, an X direction), and the n data lines 50 extend in a column direction (that is, a Y direction). The pixels 20 are arranged at intersections of the m scanning lines 40 and the n data lines 50.

The controller 10 controls operations of the scanning-line driving circuit 60, the data-line driving circuit 70, the power-supply circuit 210, and the common potential supply circuit 220. The controller 10 supplies timing signals such as a clock signal and a start pulse to the circuits, for example.

The scanning-line driving circuit 60 sequentially supplies scanning signals in the form of pulses to the scanning lines Y1 to Ym in accordance with the timing signals supplied from the controller 10.

The data-line driving circuit 70 supplies image signals to the data lines X1 to Xn in accordance with the timing signals supplied from the controller 10. Each of the image signals is brought to a binary level, that is, a high-potential level (hereinafter referred to as a "high level", for example, 5V) or a low-potential level (hereinafter referred to as a "low level", for example, 0V).

The power-supply circuit 210 supplies a high power potential VEP to a high-potential power-supply line 91, a low power potential Vss to a low-potential power-supply line 92, a first pixel potential S1 to a first control line 94, and a second pixel potential S2 to a second control line 95. Note that, although not shown, the high-potential power-supply line 91, the low-potential power-supply line 92, the first control line 94, and the second control line 95 are connected to the power-supply circuit 210 through electric switches.

The common potential supply circuit 220 supplies a common potential Vcom to a common potential line 93. Note that, although not shown, the common potential line 93 is connected to the common potential supply circuit 220 through an electric switch.

Note that although various signals are input to the controller 10, the scanning-line driving circuit 60, the data-line driving circuit 70, the power-supply circuit 210, and the common potential supply circuit 220, detailed descriptions of signals which do not relate to this embodiment are omitted.

Figure 2:
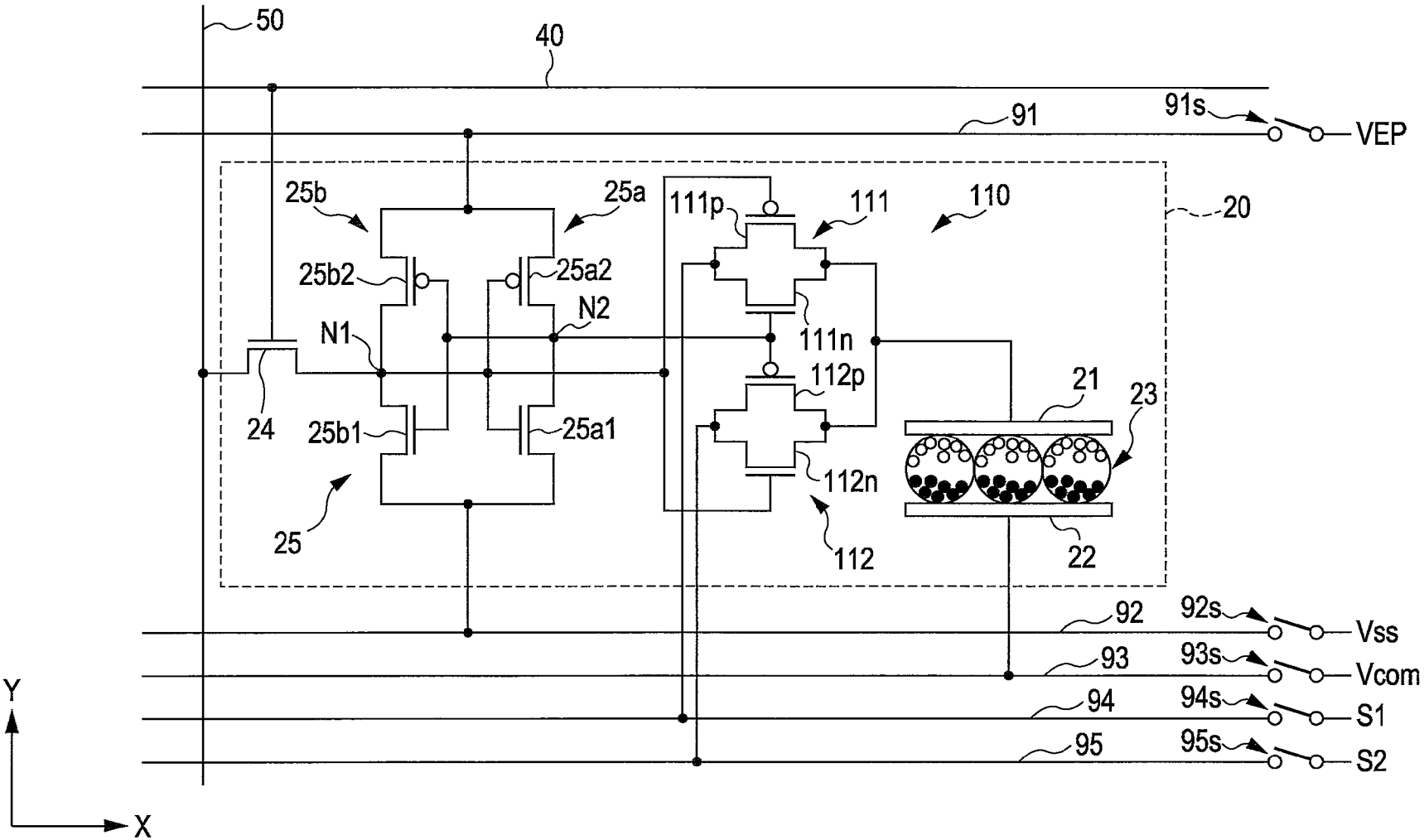
FIG. 2 is a diagram of an equivalent circuit illustrating an electric configuration of a pixel.

FIG. 2 is a diagram of an equivalent circuit illustrating an electric configuration of a pixel. Hereinafter, a description will be made taking one of the pixels 20 as an example for simplicity of description.

In FIG. 2, the pixel 20 includes a pixel-switching transistor 24, a memory circuit 25, a switch circuit 110, a pixel electrode 21, a common electrode 22, and an electrophoretic element 23.

The pixel-switching transistor 24 is an example of a "pixel-switching element" of an aspect of the invention, and is constituted by an N-transistor. A gate of the pixel-switching transistor 24 is electrically connected to one of the scanning lines 40, a source of the pixel-switching transistor 24 is electrically connected to one of the data lines 50, and a drain of the pixel-switching transistor 24 is electrically connected to an input terminal N1 of the memory circuit 25. The pixel-switching transistor 24 receives an image signal supplied through one of the data lines 50 from the data-line driving circuit 70 (refer to FIG. 1), and supplies the image signal to the input terminal N1 of the memory circuit 25 in accordance with a timing of a scanning signal supplied in the form of pulses through one of the scanning lines 40 from the scanning-line driving circuit 60 (refer to FIG. 1).

The memory circuit 25 includes inverter circuits 25*a* and 25*b*, and functions as a SRAM (Static Random Access Memory).

The inverter circuits 25*a* and 25*b* constitute a loop structure in which an input terminal of one of the inverter circuits 25*a* and 25*b* is electrically connected to an output terminal of the other of the inverter circuits 25*a* and 25*b*, and an input terminal of the other of the inverter circuits 25*a* and 25*b* is electrically connected to an output terminal the one of the inverter circuits 25*a* and 25*b*. Specifically, an input terminal of the inverter circuit 25*a* is electrically connected to an output terminal of the inverter circuit 25*b*, and an input terminal of the inverter circuit 25*b* is electrically connected to an output terminal of the inverter circuit 25*a*. The input terminal of the inverter circuit 25*a* serves as the input terminal N1 of the memory circuit 25, and the output terminal of the inverter circuit 25*a* serves as an output terminal N2 of the memory circuit 25.

The inverter circuit 25*a* includes an N-transistor 25*a*1 and a P-transistor 25*a*2. Gates of the N-transistor 25*a*1 and the P-transistor 25*a*2 are electrically connected to the input terminal N1 of the memory circuit 25. A source of the N-transistor 25*a*1 is electrically connected to the low-potential power-supply line 92 to which the low power potential Vss is supplied. A source of the P-transistor 25*a*2 is electrically connected to the high-potential power-supply line 91 to which the high power potential VEP, which is a "holding potential" according to an aspect of the invention, is supplied. Drains of the N-transistor 25*a*1 and the P-transistor 25*a*2 are electrically connected to the output terminal N2 of the memory circuit 25.

The inverter circuit 25*b* includes an N-transistor 25*b*1 and a P-transistor 25*b*2. Gates of the N-transistor 25*b*1 and the P-transistor 25*b*2 are electrically connected to the output terminal N2 of the memory circuit 25. A source of the N-transistor 25*b*1 is electrically connected to the low-potential power-supply line 92 to which the low power potential Vss is supplied. A source of the P-transistor 25*b*2 is electrically connected to the high-potential power-supply line 91 to which the high power potential VEP is supplied. Drains of the N-transistor 25*b*1 and the P-transistor 25*b*2 are electrically connected to the output terminal N1 of the memory circuit 25.

The memory circuit 25 outputs the low power potential Vss from the output terminal N2 thereof in response to a high-level image signal input to the input terminal N1 thereof, and outputs the high power potential VEP from the output terminal N2 thereof in response to a low-level image signal input to the output terminal N2 thereof. Specifically, the memory circuit 25 outputs the low power potential Vss or the high power potential VEP in accordance with whether the high-level image signal or the low-level image signal is input thereto. In other words, the memory circuit 25 can store the input image signal as the low power potential Vss or the high power potential VEP.

The high-potential power-supply line 91 and the low-potential power-supply line 92 receive the high power potential VEP and the low power potential Vss, respectively, from the power-supply circuit 210. The high-potential power-supply line 91 is electrically connected through a switch 91*s* to the power-supply circuit 210, and the low-potential power-supply line 92 is electrically connected through a switch 92*s* to the power-supply circuit 210. The switches 91*s* and 92*s* are turned on and off using the controller 10. When the switch 91*s* is turned on, the high-potential power-supply line 91 is electrically connected to the power-supply circuit 210 whereas when the switch 91*s* is turned off, the high-potential power-supply line 91 is electrically disconnected from the power-supply circuit 210, that is, the high-potential power-supply line 91 is brought to an high-impedance state. When the switch 92*s* is turned on, the low-potential power-supply line 92 is electrically connected to the power-supply circuit 210 whereas when the switch 92*s* is turned off, the low-potential power-supply line 92 is electrically disconnected from the power-supply circuit 210, that is, the low-potential power-supply line 92 is brought to an high-impedance state. That is, the controller 10 serves as an example of a "control unit" according to an aspect of the invention.

The switch circuit 110 includes a first transmission gate 111 and a second transmission gate 112.

The first transmission gate 111 includes a P-transistor 111*p* and an N-transistor 111*n*. Sources of the P-transistor 111*p* and the N-transistor 111*n* are electrically connected to the first control line 94. Drains of the P-transistor 111*p* and the N-transistor 111*n* are electrically connected to the pixel electrode 21. A gate of the P-transistor 111*p* is electrically connected to the input terminal N1 of the memory circuit 25, and a gate of the N-transistor 111*n* is electrically connected to the output terminal N2 of the memory circuit 25.

The second transmission gate 112 includes a P-transistor 112*p* and an N-transistor 112*n*. Sources of the P-transistor 112*p* and the N-transistor 112*n* are electrically connected to the second control line 95. Drains of the P-transistor 112*p* and the N-transistor 112*n* are electrically connected to the pixel electrode 21. A gate of the P-transistor 112*p* is electrically connected to the output terminal N2 of the memory circuit 25, and a gate of the N-transistor 112*n* is electrically connected to the input terminal N1 of the memory circuit 25.

The switch circuit 110 selects one of the first control line 94 and the second control line 95 in accordance with an image signal supplied to the memory circuit 25 so as to electrically connect the one of the first control line 94 and the second control line 95 to the pixel electrode 21.

Specifically, when the high-level image signal is input to the input terminal N1 of the memory circuit 25, the memory circuit 25 outputs low power potentials Vss to the gate of the N-transistor 111*n* and the gate of the P-transistor 112*p*, and outputs high power potentials VEP to the gate of the P-transistor 111*p* and the gate of the N-transistor 112*n*. Therefore, only the P-transistor 112*p* and the N-transistor 112*n* which constitute the second transmission gate 112 are brought to on states whereas the P-transistor 111*p* and the N-transistor 111*n* which constitute the first transmission gate 111 are in off states. On the other hand, when the low-level image signal is input to the input terminal N1 of the memory circuit 25, the memory circuit 25 outputs high power potentials VEP to the gate of the N-transistor 111*n* and the gate of the P-transistor 112*p*, and outputs low power potentials Vss to the gate of the P-transistor 111*p* and the gate of the N-transistor 112*n*. Therefore, only the P-transistor 111*p* and the N-transistor 111*n* which constitute the first transmission gate 111 are brought to on states whereas the P-transistor 112*p* and the N-transistor 112*n* which constitute the second transmission gate 112 are in off states. That is, when the high-level image signal is input to the input terminal N1 of the memory circuit 25, only the second transmission gate 112 is brought to an on state whereas when the low-level image signal is input to the input terminal N1 of the memory circuit 25, only the first transmission gate 111 is brought to an on state.

The first control line 94 and the second control line 95 receive the first pixel potential S1 and the second pixel potential S2, respectively, from the power-supply circuit 210. The first control line 94 is electrically connected through a switch 94*s* to the power-supply circuit 210, and the second control line 95 is electrically connected through a switch 95*s* to the power-supply circuit 210. The switches 94*s* and 95*s* are turned on and off using the controller 10. When the switch 94*s* is turned on, the first control line 94 is electrically connected to the power-supply circuit 210 whereas when the switch 94*s* is turned off, the first control line 94 is electrically disconnected from the power-supply circuit 210, that is, the first control line 94 is brought to a high-impedance state. When the switch 95*s* is turned on, the second control line 95 is electrically connected to the power-supply circuit 210 whereas when the switch 95*s* is turned off, the second control line 95 is electrically disconnected from the power-supply circuit 210, that is, the second control line 95 is brought to a high-impedance state.

The pixel electrodes 21 included in the pixel 20 are electrically connected to one of the first control line 94 and the second control line 95 which is selected using the switch circuit 110 in accordance with an image signal. Then, each of the pixel electrodes 21 included in the pixel 20 receives one of the first pixel potential S1 and the second pixel potential S2 from the power-supply circuit 210 in accordance with the state of the switch 94*s* or the state of the switch 95*s*, or are brought to high-impedance states.

Specifically, among the pixels 20, in pixels 20 to which low-level image signals are supplied, only first transmission gates 111 are brought to on states. Pixel electrodes 21 included in the pixels 20 to which the low-level image signals are supplied are electrically connected to the first control line 94. In accordance with the state of the switch 94*s*, the pixel electrodes 21 receive the first pixel potentials S1 supplied from the power-supply circuit 210, or are brought to high-impedance states. On the other hand, among the pixels 20, in pixels 20 to which high-level image signals are supplied, only second transmission gates 112 are brought to on states. Pixel electrodes 21 included in the pixels 20 to which the high-level image signals are supplied are electrically connected to the second control line 95. In accordance with the state of the switch 95*s*, the pixel electrodes 21 receive the second pixel potentials S2 supplied from the power-supply circuit 210, or are brought to high-impedance states.

The pixel electrode 21 is arranged so as to face the common electrode 22 with the electrophoretic element 23 interposed therebetween.

The common electrode 22 is electrically connected to the common potential line 93 to which the common potential Vcom is supplied. The common potential line 93 receives the common potential Vcom from the common potential supply circuit 220. The common potential line 93 is electrically connected to the common potential supply circuit 220 through a switch 93*s*. The switch 93*s* is turned on or off using the controller 10. When the switch 93*s* is turned on, the common potential line 93 is electrically connected to the common potential supply circuit 220 whereas when the switch 93*s* is turned off, the common potential line 93 is electrically disconnected from the common potential supply circuit 220, that is, the common potential line 93 is brought to a high-impedance state.

The electrophoretic element 23 includes a plurality of microcapsules each including electrophoretic particles.

A configuration of the display unit 3 of the electrophoretic display device 1 according to this embodiment will now be described in detail with reference to FIGS. 3 and 4.

Figure 3:
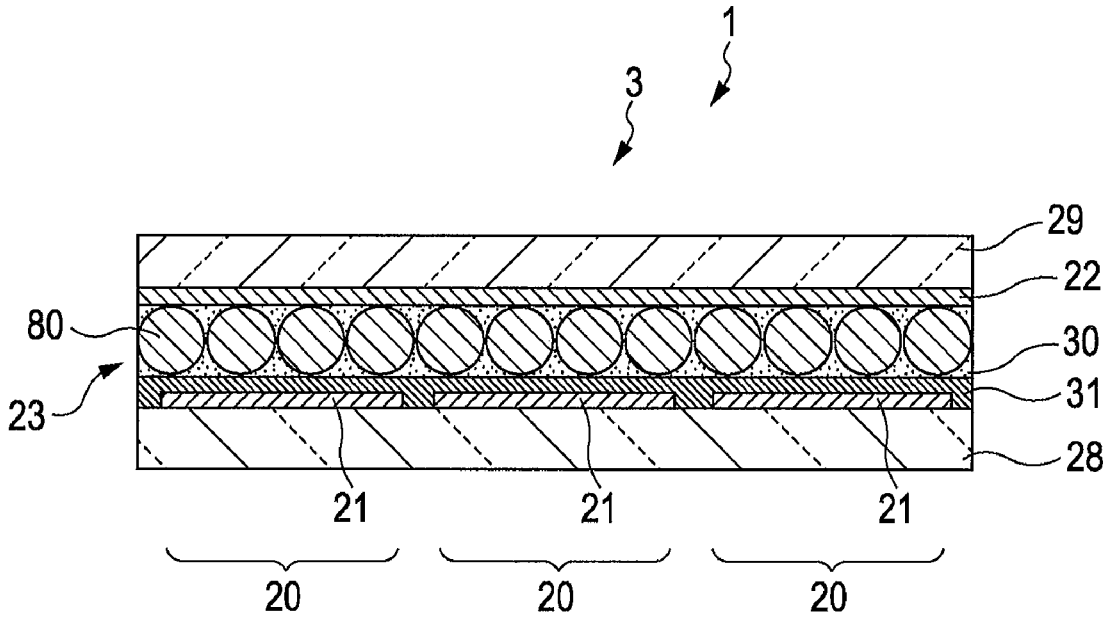
FIG. 3 is a partial sectional view illustrating a display unit of the electrophoretic display device according to the embodiment.

FIG. 3 is a partial sectional view illustrating the display unit 3 of the electrophoretic display device 1 according to this embodiment.

In FIG. 3, the display unit 3 includes an element substrate 28, a counter substrate 29, and the electrophoretic element 23 interposed between the element substrate 28 and the counter substrate 29. Note that, in this embodiment, it is assume that an image is displayed on the counter substrate 29 side.

The element substrate 28 is formed of glass or plastic, for example. Although not shown, the element substrate 28 has a layered structure including the pixel-switching transistors 24, the memory circuits 25, the switch circuits 110, the scanning lines 40, the data lines 50, the high-potential power-supply line 91, the low-potential power-supply line 92, the common potential line 93, the first control line 94, and the second control line 95, which are described above with reference to FIG. 2, arranged thereon. In addition, the plurality of pixel electrodes 21 are arranged in a matrix on the layered structure.

The counter substrate 29 is a transparent substrate formed of glass or plastic, for example. A surface of the counter substrate 29 which faces the element substrate 28 includes the common electrode 22 arranged thereon so that the common electrode 22 faces the plurality of solid pixel electrodes 21. The common electrode 22 is formed of transparent conductive material such as magnesium-silver (MgAg), indium tin oxide (ITO), or indium zinc oxide (IZO).

The electrophoretic element 23 includes a plurality of microcapsules 80 each having electrophoretic particles. The electrophoretic element 23 is fixed between the element substrate 28 and the counter substrate 29 using a binder 30 and a bonding layer 31 which are formed of resin, for example. Note that, in processing of manufacturing the electrophoretic display device 1 of this embodiment, an electrophoretic sheet which includes the electrophoretic element 23 fixed on a surface thereof on the counter substrate 29 side using the binder 30 in advance is attached using the bonding layer 31 to the element substrate 28 which includes the pixel electrodes 21 arranged thereon and which is separately manufactured.

The microcapsules 80 are sandwiched between the pixel electrodes 21 and the common electrode 22. At least one of the microcapsules 80 is included in each of the pixels 20 (that is, in each of the pixel electrodes 21).

Figure 4:
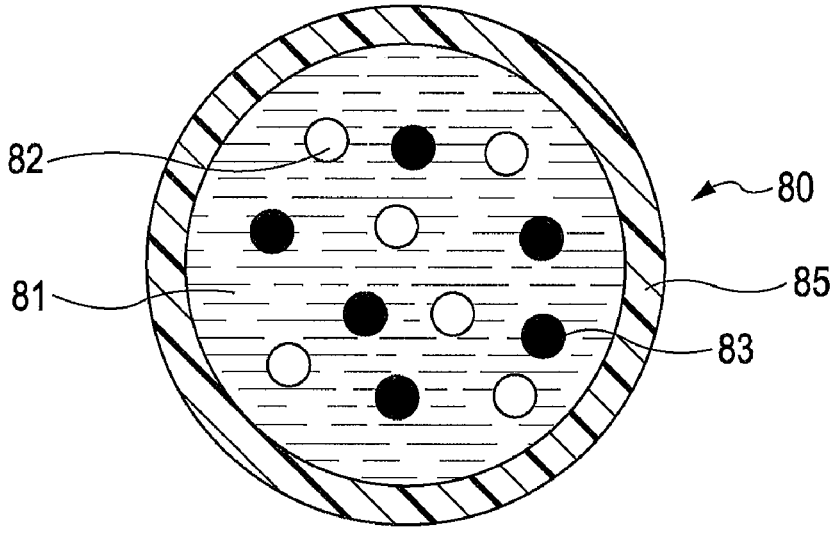
FIG. 4 is a diagram schematically illustrating a configuration of a microcapsule.

FIG. 4 is a diagram schematically illustrating a configuration of one of the microcapsules 80. Note that FIG. 4 schematically shows a sectional view of one of the microcapsules 80. Hereinafter, a description will be made taking one of the microcapsules 80 as an example.

As shown in FIG. 4, the microcapsule 80 includes a coating film 85, and the coating film 85 further includes a dispersion medium 81, a plurality of white particles 82, and a plurality of black particles 83. The microcapsule 80 has a spherical shape having a particle diameter of 50 μm, for example. Note that the white particles 82 and the black particles 83 correspond to examples of "electrophoretic particles" according to an aspect of the invention.

The coating film 85 functions as an outer envelope of the microcapsule 80 and is formed of acrylic resin such as polymethylmethacrylate or polyethylmethacrylate, urea resin, or polymer resin having translucency such as gum arabic.

The dispersion medium 81 is used to disperse the white particles 82 and the black particles 83 in the microcapsule 80 (that is, in the coating film 85). Examples of the dispersion medium 81 include water, alcohol solvent such as methanol, ethanol, isopropanol, butanol, octanol, or methyl cellsolve, various esters such as acetic ether, and butyl acetate, ketones such as acetone, methyl ethyl ketone, and methyl isobutyl ketone, aliphatic hydrocarbon such as pentane, hexane, or octane, alicyclic hydrocarbon such as cyclohexane or methylcyclohexane, benzene, toluene, aromatic hydrocarbon including benzenes having long-chain alkyl groups such as xylene, hexylbenzene, hebutylbenzene, octylbenzene, nonylbenzene, decylbenzene, undecylbenzene, dodecylbenzene, tridecylbenzene, and tetradecylbenzene, halogenated hydrocarbon such as methylene chloride, chloroform, carbon tetrachloride, or 1,2-dichloroethane, carboxylate, other oils, and a combination thereof. The dispersion medium 81 may include a surface-active agent.

The white particles 82 are particles (polymer particles or colloid particles) formed of white pigment such as titanium dioxide, Chinese white (zinc oxide), or antimony trioxide, and are electrically charged in negative.

The black particles 83 are particles (polymer particles or colloid particles) formed of black pigment such as aniline black or carbon black, and are electrically charged in positive.

Accordingly, the white particles 82 and the black particles 83 are moved in the dispersion medium 81 due to an electric field generated due to a potential difference between the pixel electrodes 21 and the common electrode 22.

Note that, dispersion agents such as electrolytes, surface-active agents, metallic soaps, gums, oils, varnishes, charge-control agents including particles such as compounds, titanium-based coupling agents, aluminum-based coupling agents, or silane-based coupling agents, lubricant agents, or stabilizing agents may be added to the pigments as needed.

In FIGS. 3 and 4, when a voltage is applied between the pixel electrodes 21 and the common electrode 22 so that a potential of the common electrode 22 becomes higher, the black particles 83 electrically charged in positive are attracted toward the pixel electrodes 21 side in the microcapsule 80 by Coulomb's force, whereas the white particles 82 electrically charged in negative are attracted toward the common electrode 22 side in the microcapsule 80 by Coulomb's force. Accordingly, since the white particles 82 are collected on a display plane side (that is, on the common electrode 22 side) of the microcapsule 80, color (that is, white) of the white particles 82 are displayed in the display plane of the display unit 3. Conversely, when a voltage is applied between the pixel electrodes 21 and the common electrode 22 so that potentials of the pixel electrodes 21 become relatively higher, the white particles 82 which are charged in negative are attracted toward the pixel electrodes 21 side by Coulomb's force whereas the black particles 83 are attracted toward the common electrode 22 side by Coulomb's force. Accordingly, since the black particles 83 are collected on the display plane side of the microcapsule 80, color (that is, black) of the black particles 83 are displayed in the display plane of the display unit 3.

In addition, gray-tone color such as light gray, gray, or dark gray which is a halftone between black and white may be displayed in accordance with a dispersion state of the white particles 82 and the black particles 83 which are interposed between the pixel electrodes 21 and the common electrode 22. For example, a voltage is applied between the pixel electrodes 21 and the common electrode 22 so that the potentials of the pixel electrodes 21 become higher so that the black particles 83 are collected on the display plane side of the microcapsule 80 and the white particles 82 are collected on a pixel electrode 21 side of the microcapsule 80. Thereafter, for a predetermined period in accordance with a halftone to be displayed, a voltage is applied between the pixel electrodes 21 and the common electrode 22 so that the potential of the common electrode 22 becomes relatively higher. By this, a predetermined number of the white particles 82 are moved to the display plane side of the microcapsule 80, and a predetermined number of the black particles 83 are moved to the pixel electrode 21 side of the microcapsule 80. In this way, gray tone which is a halftone between black and white can be displayed in the display plane of the display unit 3.

Note that the pigments used for the white particles 82 and the black particles 83 may be replaced by pigments of red, green, or blue so that red, green, or blue, for example, is displayed.

Referring to FIGS. 5 to 10, operation of a driving circuit for the electrophoretic display device 1 included in the electrophoretic display device 1 will now be described.

Figure 5:
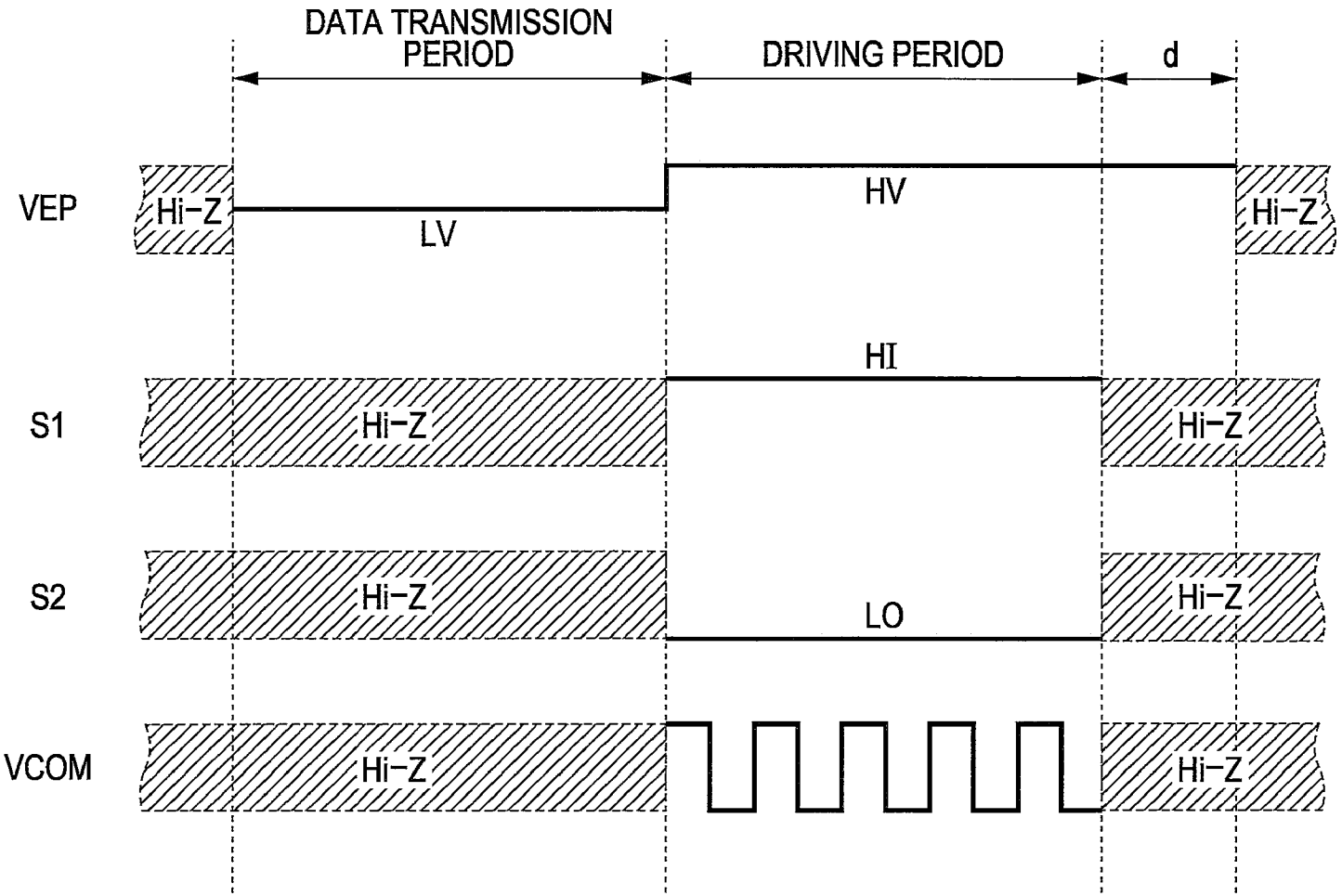
FIG. 5 is a first timing chart illustrating potential change which occurs in time series in a driving circuit for the electrophoretic display device according to the embodiment.

FIG. 5 is a first timing chart illustrating potential change which occurs in time series in the driving circuit for the electrophoretic display device 1 according to this embodiment. Note that, in FIG. 5, a high-impedance state is denoted by "Hi-Z".

As shown in FIG. 5, the driving circuit for the electrophoretic display device 1 according to this embodiment supplies a potential LV (for example, 5V) as the high power potential VEP through the high-potential power-supply line 91 to the memory circuit 25 in a data transmission period (that is, in a period in which an image signal is supplied from a data line X through the pixel-switching transistor 24 to the memory circuit 25). The memory circuit 25 holds the image signal using the potential LV. Supply of the first pixel potential S1, the second pixel potential S2, and the common potential Vcom is stopped when the switches 93*s*, 94*s*, and 95*s* are opened. That is, the pixel electrodes 21 and the common electrode 22 are in high-impedance states.

Subsequently, in a driving period (that is, a period in which the first pixel potential S1 or the second pixel potential S2 is written to the pixel electrodes 21, i.e., a period in which the electrophoretic element 23 is moved by a voltage applied between the pixel electrodes 21 an the common electrode 22), the high power potential VEP should be a potential HV (for example, 15V) which is higher than the potential LV in order to enhance a potential output from the memory circuit 25. Furthermore, the switches 94*s* and 95*s* are closed, the first pixel potential S1, i.e., a potential HI (for example, 15V) is supplied to the first control line 94, and the second pixel potential S2, i.e., a potential LO (for example, 0V) is supplied to the second control line 95. The pixel electrodes 21 are electrically connected one of the first control line 94 and the second control line 95 which is selected using the memory circuit 25 in accordance with a signal output from the memory circuit 25. Therefore, one of the potential HI and the potential LO is supplied to the pixel electrodes 21. Then, the switch 93*s* is closed, and the common potential Vcom is supplied through the common potential line 93 to the common electrode 22. Note that, in this embodiment, a driving operation in which a potential of the common potential Vcom is changed every predetermined period (that is, so-called "common swing driving") is performed. Note that the common swing driving is merely an example of a driving method, and the common potential Vcom may be a constant potential, for example.

After the driving period is terminated, the switches 93*s*, 94*s*, and 95*s* are opened again, and the supply of the first pixel potential S1, the second pixel potential S2, and the common potential Vcom is stopped. Note that supply of the high power potential VEP, among the various potentials shown in FIG. 5, is not stopped. The high power potential VEP having the potential HV is held even after the supply of the first pixel potential S1, the second pixel potential S2, and the common potential Vcom is stopped. Supply of the high power potential VEP is stopped after a delay period d has passed. The delay period d is set as a period equal to or longer than 100 msec, preferably as a period of several seconds.

Figure 6:
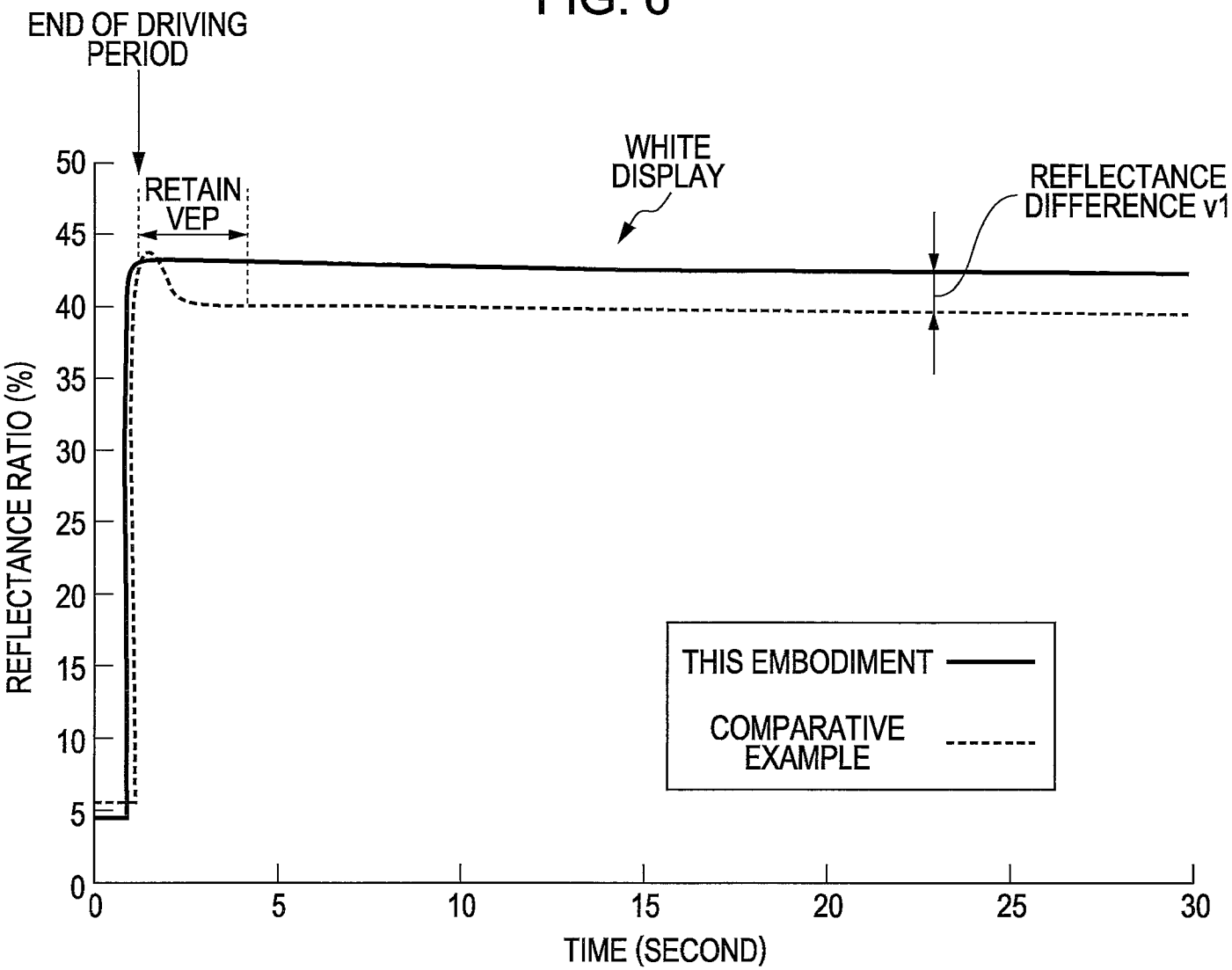
FIG. 6 is a graph illustrating change of a reflectance ratio of the electrophoretic display device according to the embodiment and change of a reflectance ratio of an electrophoretic display device according to a comparative example when white display is performed using the electrophoretic element.
Figure 7:
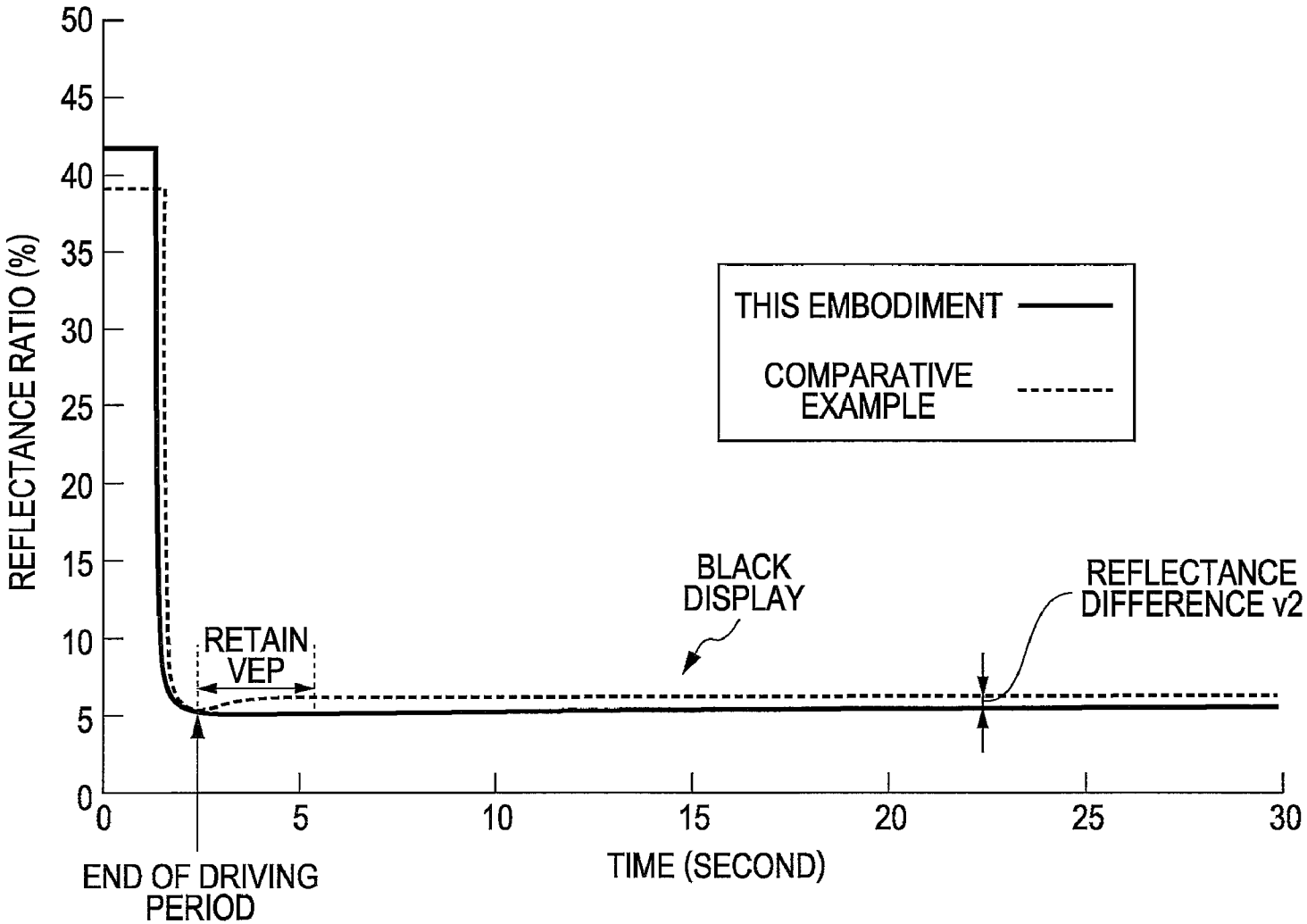
FIG. 7 is a graph illustrating change of a reflectance ratio of the electrophoretic display device according to the embodiment and change of a reflectance ratio of an electrophoretic display device according to a comparative example when black display is performed using the electrophoretic element.

FIG. 6 is a graph illustrating change of a reflectance ratio of the electrophoretic display device according to this embodiment and change of a reflectance ratio of an electrophoretic display device according to a comparative example when white display is performed using the electrophoretic element. FIG. 7 is a graph illustrating change of a reflectance ratio of the electrophoretic display device according to this embodiment and change of a reflectance ratio of an electrophoretic display device according to the comparative example when black display is performed using the electrophoretic element. Note that solid lines in the graphs denote changes of the reflectance ratios (that is, levels of grayscale) of the microcapsules 80 driven as described above, and dotted lines denote changes of reflectance ratios when the first pixel potential S1, the second pixel potential S2, the common potential Vcom, and the high power potential VEP are simultaneously stopped after the driving period is terminated.

According to the comparative examples shown in FIGS. 6 and 7, immediately after the driving period is terminated (that is, immediately after the supply of the various potentials is stopped), levels of grayscale are considerably changed as indicated by the dotted lines in the graphs. This is because the kickback phenomenon in which the white particles 82 and the black particles 83 are moved back toward original positions occurs. When the kickback phenomenon occurs, the reflectance ratio is deteriorated in the white display as shown in FIG. 6 whereas the reflectance ratio is increased in the black display as shown in FIG. 7. Accordingly, contrast of an image displayed in the display unit 3 is deteriorated.

On the other hand, as indicated by the solid lines in the graphs, in the driving operation according to this embodiment, after the driving period is terminated, the high power potential VEP is held for three seconds. Therefore, occurrence of the kickback phenomenon is suppressed, and therefore, unlike the comparative example described above, the reflectance ratio is not considerably changed. Accordingly, the reflectance ratio is maintained high in the white display and therefore true white display is performed. On the other hand, the reflectance ration is maintained low in the black display and therefore true black display is performed. Consequently, the deterioration of contrast is suppressed.

Note that the relationship between a reflectance-ratio difference v1 (that is, a difference between the reflectance ratios in the white display), which is a difference between the reflectance ratio of this embodiment and the reflectance ratio of the comparative example, and a reflectance-ratio difference v2 (that is, a difference between the reflectance ratios in the black display), which is a difference between the reflectance ratio of this embodiment and the reflectance ratio of the comparative example, is denoted as follows: v1>v2. That is, an advantage of this embodiment is more effective in the white display.

Figure 8:
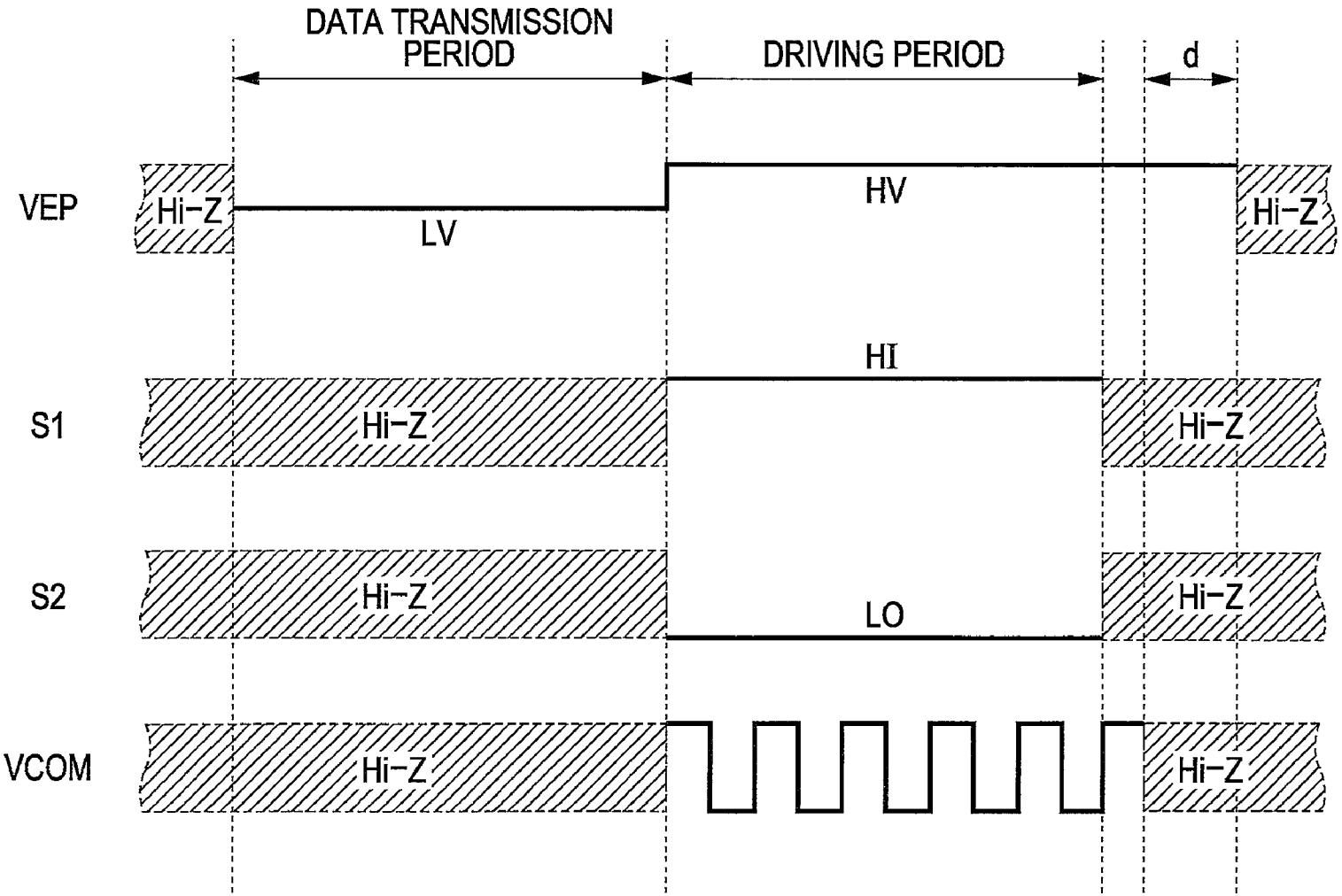
FIG. 8 is a second timing chart illustrating potential change which occurs in time series in the driving circuit for the electrophoretic display device according to the embodiment.
Figure 9:
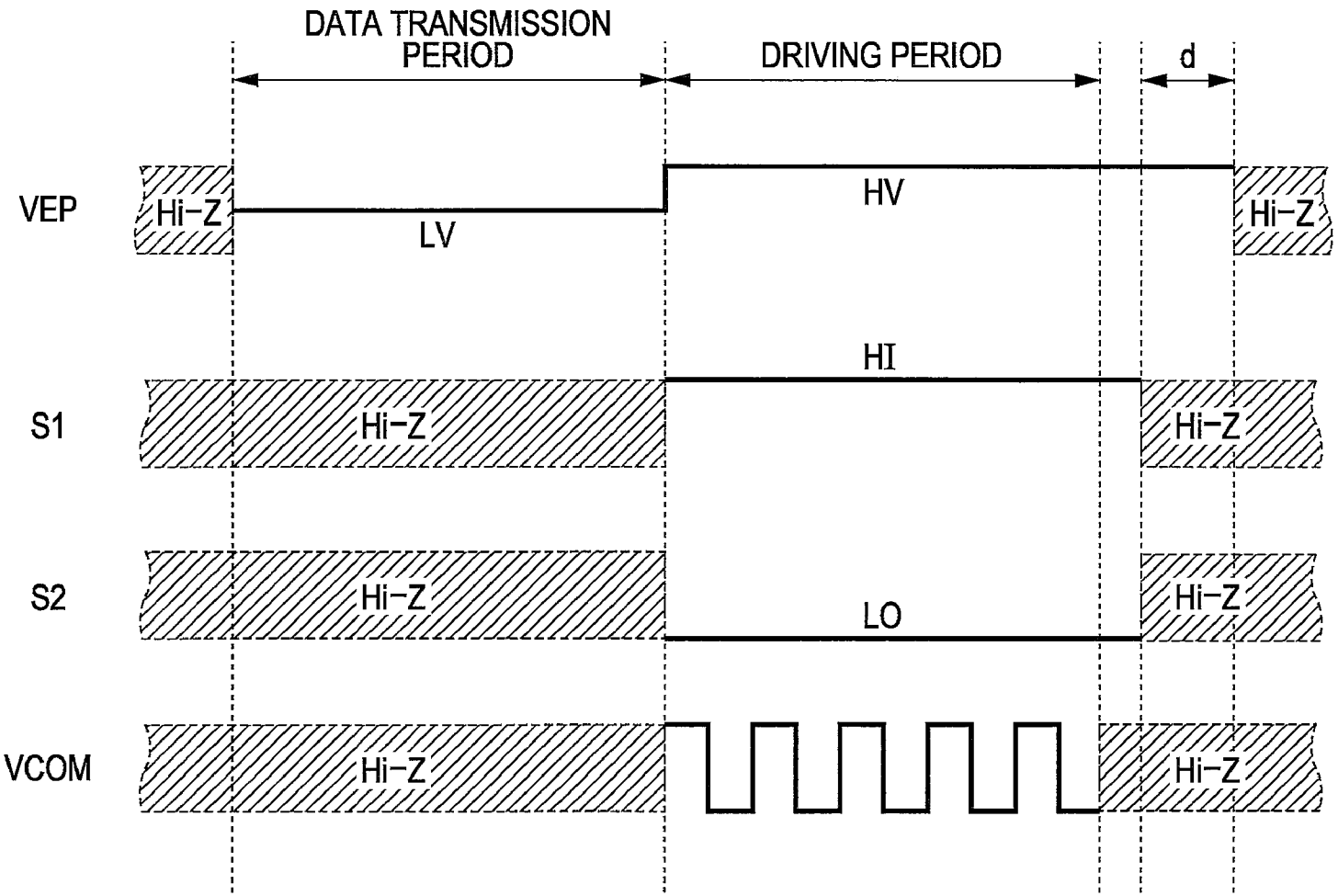
FIG. 9 is a third timing chart illustrating potential change which occurs in time series in the driving circuit for the electrophoretic display device according to the embodiment.

FIG. 8 is a second timing chart illustrating potential change which occurs in time series in the driving circuit for the electrophoretic display device according to this embodiment. FIG. 9 is a third timing chart illustrating potential change which occurs in time series in the driving circuit for the electrophoretic display device according to this embodiment.

In FIGS. 8 and 9, it is not necessarily the case that the supply of the common potential Vcom is stopped simultaneously with the stop of the supply of the first pixel potential S1 and the second pixel potential S2. Specifically, the supply of the common potential Vcom may be stopped after the supply of the first pixel potential S1 and the second pixel potential S2 is stopped as shown in FIG. 8, or the supply of the common potential Vcom may be stopped before the supply of the first pixel potential S1 and the second pixel potential S2 is stopped as shown in FIG. 9. In any case, the occurrence of the kickback phenomenon is suppressed when the supply of the high power potential VEP is stopped after the supply of the three potentials, that is, the first pixel potential S1, the second pixel potential S2, and the common potential Vcom is stopped and the delay time d has passed. In other words, among the four potentials, that is, the first pixel potential S1, the second pixel potential S2, the common potential Vcom, and the high power potential VEP, when the high power potential VEP is stopped last, the advantage of this embodiment is attained.

Figure 10:
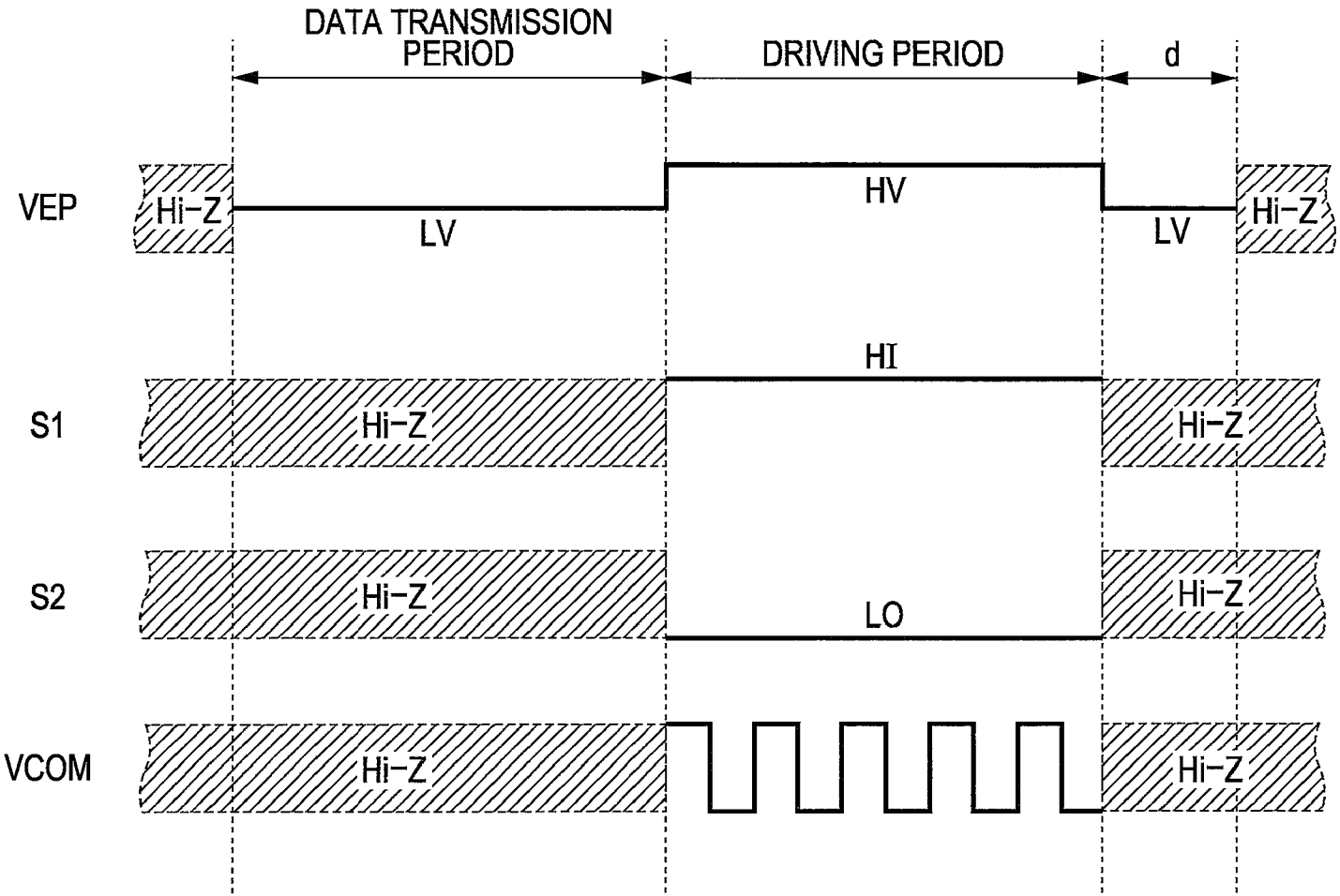
FIG. 10 is a fourth timing chart illustrating potential change which occurs in time series in the driving circuit for the electrophoretic display device according to the embodiment.

FIG. 10 is a fourth timing chart illustrating potential change which occurs in time series in the driving circuit for the electrophoretic display device according to the embodiment.

As shown in FIG. 10, the high power potential VEP may have the potential LV which is lower than the potential HV in the delay period d. That is, the high power potential VEP may be controlled so as to have a low potential after the droving period is terminated. The high power potential VEP supplied in the delay period d is used to suppress the kickback phenomenon as described above, and is not used for the driving operation performed so that an image is displayed by holding or outputting an image signal, for example. Therefore, even when the high power potential VEP has a low potential, the image displayed in the display unit 3 is not influenced by the low potential. Accordingly, since the high power potential VEP have the low potential, power consumption is reduced.

As described above, according to the driving circuit for the electrophoretic display device and the method for driving the electrophoretic display device according to this embodiment, the kickback phenomenon is effectively suppressed in a simple way. Accordingly, a high-quality image can be displayed.

Note that a principle for suppression of the kickback phenomenon by employing the driving operation of stopping the supply of the high power potential VEP last is not completely apparent here. However, the inventor et al. have examined a plurality of verification experiments including the cases represented by the graphs of FIGS. 6 and 7 described above, and have created this invention in accordance with data obtained as results of the experiments.

Next, an electronic apparatus to which the electrophoretic display device described above is applied will be described with reference to FIGS. 11 and 12. Hereinafter, a case where the electrophoretic display device described above is used as an electronic sheet or a case where the electrophoretic display device described above is used as an electronic note will be described as examples.

Figure 11:
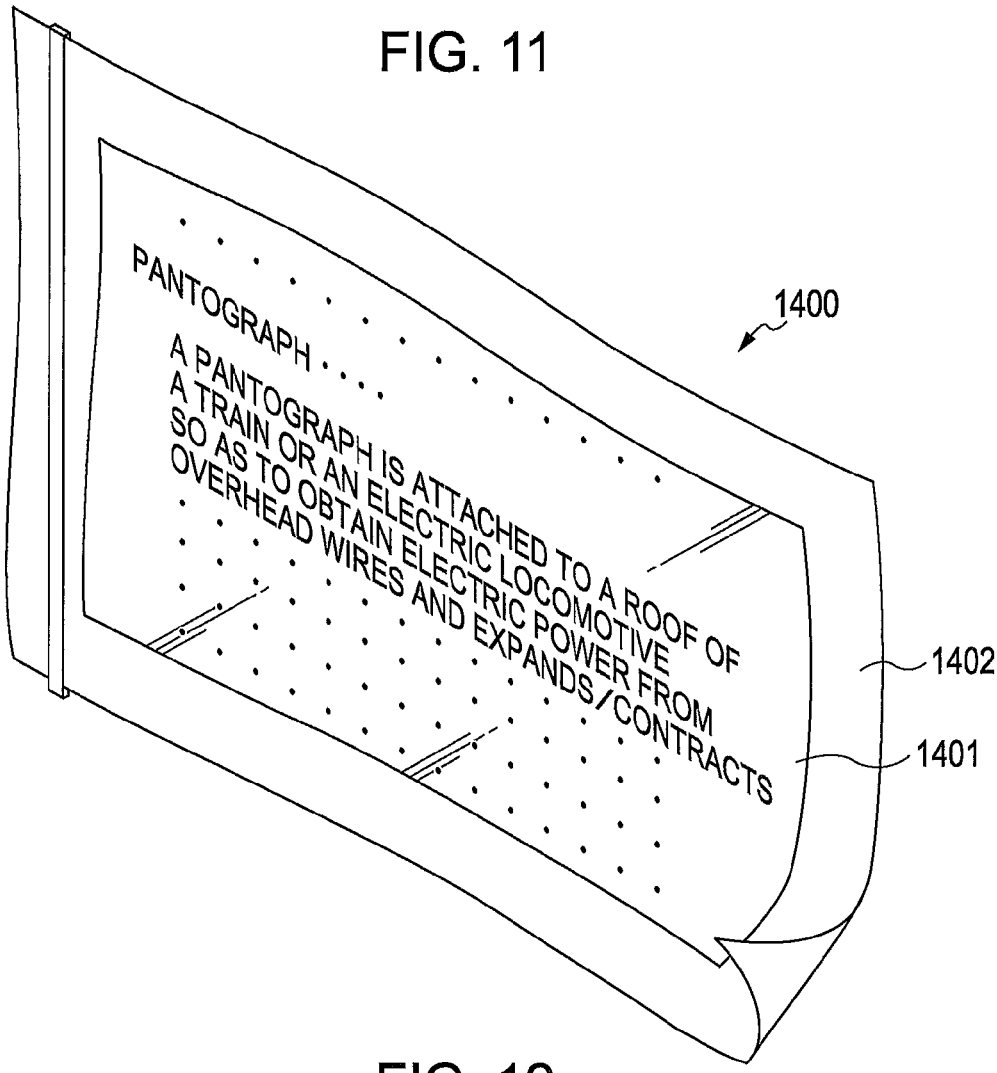
FIG. 11 is a perspective view illustrating a configuration of an electronic sheet which is an example of an electronic apparatus to which the electrophoretic display device is applied.

FIG. 11 is a perspective view illustrating a configuration of an electronic sheet 1400.

As shown in FIG. 11, the electronic sheet 1400 includes the electrophoretic display device according to the foregoing embodiment serving as a display unit 1401. The flexible electronic sheet 1400 further includes a body 1402 formed of a flexible sheet which has texture the same as that of general sheets and which is rewritable.

Figure 12:
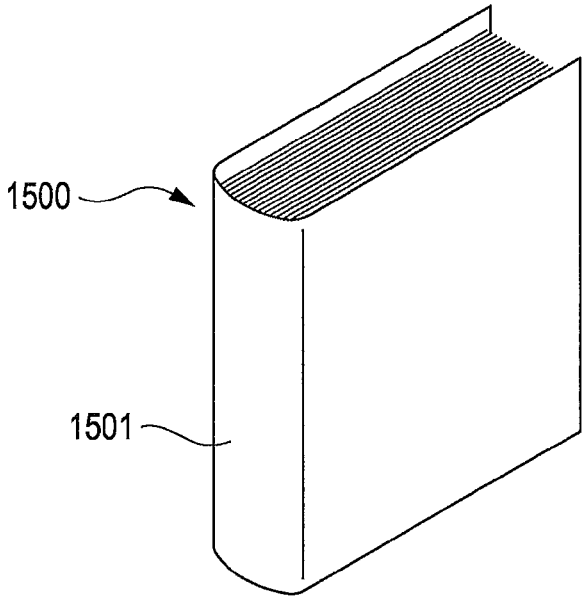
FIG. 12 is a perspective view illustrating a configuration of an electronic note which is an example of the electronic apparatus to which the electrophoretic display device is applied.

FIG. 12 is a perspective view illustrating a configuration of an electronic note 1500.

As shown in FIG. 12, the electronic note 1500 includes a plurality of electronic sheets 1400 shown in FIG. 11 which are bound with one another and a cover 1501 which covers the plurality of electronic sheets 1400. The cover 1501 includes a display-data input unit (not shown) used to input display data supplied from an external apparatus, for example. With this configuration, in accordance with the display data, display content may be changed or updated while the electric sheets are bound.

Since each of the electronic sheet 1400 and the electronic note 1500 includes the electrophoretic display device of the embodiment described above, a high-quality image can be displayed.

Note that, in addition to these, the electrophoretic display device according to the foregoing embodiment is applicable to display units included in an electronic apparatus such as a wrist watch, a cellular phone, and a mobile audio device.

The invention is not limited to the foregoing embodiment, and various modifications may be made without departing from the spirit and the scope of the invention which can be understood from the claims and the entire specification. Therefore, driving circuits for electrophoretic display devices, the electrophoretic display devices, and methods for driving the electrophoretic display devices, which are obtained as modifications of the foregoing embodiment are also included in a technical range of the invention.

The entire disclosure of Japanese Patent Application No. 2008-075654, filed Mar. 24, 2008 is expressly incorporated by reference herein.

What is claimed is:

1. A driving circuit for an electrophoretic display device, the display device including:
- a first control line and a second control line; and
- a display unit including a plurality of pixels, each of the plurality of pixels having:
  - a pixel electrode;
  - a common electrode facing the pixel electrode;
  - an electrophoretic element which has electrophoretic particles interposed between the pixel electrode and the common electrode;
  - a pixel-switching element;
  - a memory circuit capable of holding an image signal supplied through the pixel-switching element; and
  - a switching circuit used to electrically connect one of the first and the second control lines to the pixel electrode in accordance with a signal output in response to the image signal supplied from the memory circuit, the driving circuit comprising:
- a holding voltage supplying unit configured to supply a holding voltage used to hold the image signal to the memory circuit;
- a pixel potential supplying unit configured to supply a first pixel potential to the first control line and a second pixel potential, which is different from the first pixel potential, to the second control line;
- a common potential supplying unit configured to supply a common potential to the common electrode; and
- a control unit configured to control the holding potential supplying unit, the common potential supplying unit, and the pixel potential supplying unit so that supply of the holding potential is stopped after supply of the first and second pixel potentials and supply of the common potential are stopped.

2. The driving circuit for the electrophoretic display device, according to claim 1, wherein the control unit controls the holding potential supplying unit so that the holding potential obtained in a period after the supply of the first and second pixel potentials and the supply of the common potential are stopped and before the supply of the holding potential is stopped is lower than the holding potential obtained when the supply of the first and second pixel potentials and the supply of the common potential are stopped.

3. The driving circuit for the electrophoretic display device, according to claim 1, wherein the control unit controls the holding potential supplying unit, the common potential supplying unit, and the pixel potential supplying unit so that the supply of the holding potential is stopped at least 100 msec after the supply of the first and second pixel potentials and the supply of the common potential are stopped.

4. An electrophoretic display device comprising:
- a first control line and a second control line;
- a display unit including a plurality of pixels, each of the plurality of pixels including:
  - a pixel electrode;
  - a common electrode facing the pixel electrode;
  - an electrophoretic element which has electrophoretic particles interposed between the pixel electrode and the common electrode;

a pixel-switching element;

a memory circuit capable of holding an image signal supplied through the pixel-switching element; and a switching circuit used to electrically connect one of the first and the second control lines to the pixel electrode in accordance with a signal output in response to the image signal supplied from the memory circuit, a holding voltage supplying unit configured to supply a holding voltage used to hold the image signal to the memory circuit;

a pixel potential supplying unit configured to supply a first pixel potential to the first control line and a second pixel potential, which is different from the first pixel potential, to the second control line;

a common potential supplying unit configured to supply a common potential to the common electrode; and a control unit configured to control the holding potential supplying unit, the common potential supplying unit, and the pixel potential supplying unit so that supply of the holding potential is stopped after supply of the first and second pixel potentials and supply of the common potential are stopped.

5. A method for driving an electrophoretic display device, the display device including:

a first control line and a second control line; and a display unit including a plurality of pixels, each of the plurality of pixels having:

a pixel electrode;

a common electrode facing the pixel electrode;

an electrophoretic element which has electrophoretic particles interposed between the pixel electrode and the common electrode;

a pixel-switching element;

a memory circuit capable of holding an image signal supplied through the pixel-switching element; and a switching circuit used to electrically connect one of the first and the second control lines to the pixel electrode in accordance with a signal output in response to the image signal supplied from the memory circuit, the method comprising:

supplying a holding voltage used to hold the image signal to the memory circuit;

supplying a first pixel potential to the first control line and a second pixel potential, which is different from the first pixel potential, to the second control line; and supplying a common potential to the common electrode, wherein supply of the holding potential is stopped after supply of the first and second pixel potentials and supply of the common potential are stopped.

6. An electronic apparatus including the electrophoretic display device according to claim 4.

* * * * *